US006745844B2

(12) United States Patent
Henderson

(10) Patent No.: US 6,745,844 B2
(45) Date of Patent: Jun. 8, 2004

(54) HYDRAULIC POWER SOURCE FOR DOWNHOLE INSTRUMENTS AND ACTUATORS

(75) Inventor: William David Henderson, Tioga, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/101,684

(22) Filed: Mar. 19, 2002

(65) Prior Publication Data

US 2003/0178205 A1 Sep. 25, 2003

(51) Int. Cl.[7] ..... E21B 33/12; E21B 23/00; E21B 4/04

(52) U.S. Cl. ..... 166/386; 166/66.4; 166/129; 166/133; 166/182; 175/104

(58) Field of Search ..... 166/373, 381, 166/386, 387, 65.1, 66.4, 179, 126, 129, 131, 133, 142, 148, 151, 183, 184–186, 188; 175/92, 93, 104, 106, 107

(56) References Cited

U.S. PATENT DOCUMENTS 4,022,274 A 5/1977 Jett ..... 166/118
4,132,269 A * 1/1979 Chasteen ..... 166/268
4,515,225 A * 5/1985 Dailey ..... 175/40
4,532,614 A * 7/1985 Peppers ..... 367/81
5,149,984 A * 9/1992 Schultz et al. ..... 290/54
5,479,991 A * 1/1996 Robison et al. ..... 166/387
5,516,603 A * 5/1996 Holcombe ..... 429/127
6,012,518 A * 1/2000 Pringle et al. ..... 166/66.4
6,253,857 B1 * 7/2001 Gano ..... 166/386
6,380,476 B1 * 4/2002 Heijnen et al. ..... 136/208
6,554,074 B2 * 4/2003 Longbottom ..... 166/372
2003/0116969 A1 * 6/2003 Skinner et al. ..... 290/1 R

* cited by examiner

*Primary Examiner*—David Bagnell
*Assistant Examiner*—Jennifer H Gay
(74) *Attorney, Agent, or Firm*—Albert C. Metrailer

(57) ABSTRACT

Disclosed is a system for using pressure differential between completion fluid in an oil well and produced fluids to power downhole devices, including instruments and actuators. A conduit is provided bypassing a packer which seals a production string to a well casing. A control system, including a flow valve, allows fluid to flow to an electrical generator as needed to charge an electrical storage device. Downhole electrically operated devices, e.g. a temperature sensor and signal transmitter, draw power from the storage device. Alternatively, fluid may also be directed to hydraulically driven actuators to, for example, operate a production fluid control valve.

39 Claims, 4 Drawing Sheets

HYDRAULIC POWER SOURCE FOR DOWNHOLE INSTRUMENTS AND ACTUATORS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

This invention relates to producing petroleum wells and more particularly to a system using the difference in fluid pressure across a packer in a producing well to provide power to downhole instruments or actuators.

The logging of oil and gas wells has been a standard practice for many years. Logging generally means placing an instrument in a borehole to measure various parameters to determine characteristics of the earth formations which have been drilled through. For instance, electrical resistivity of the earth formations may be measured as an indicator of whether the formations contain water or oil. Originally, logging could only be performed after the drill string, i.e. drill pipe and bit, was removed from the borehole. The logging instruments were normally supported by a wireline which provided mechanical support for the logging device in the borehole and provided electrical conductors to supply power to the device and to send signals between the device and equipment at the surface location of the well.

More recently, logging while drilling and measurement while drilling devices have been installed in the drill string to make measurements during the drilling process. While some of these devices require that drilling be stopped while measurements are taken, they avoid the expense of pulling the drill string out of the borehole. These devices provide information in real time, or near real time, and have proven beneficial during the drilling process. Since these devices must operate as part of an operating drill string, it has proven difficult or impractical to provide electrical conductors to supply power to the devices and communicate signals between the devices and equipment at the surface location of the well. Power is usually provided by batteries or mud driven downhole generators. Signals may be transmitted up and down hole by acoustic waves or pulses in the mud column or the drill pipe, all referred to herein as acoustic telemetry. Some systems use electromagnetic waves or pulses to transmit signals up and down hole, all referred to herein as electromagnetic or EM telemetry.

After drilling and logging a well, equipment may be installed for testing producing zones. For example a drill string or coiled tubing with an inflatable packer may be run down an uncased borehole to a location just above the producing zone. The packer may then be inflated to form a fluid seal between the tubing and the wall of the borehole. The well may then be produced for testing purposes through the drill string or coiled tubing. The drill string or coiled tubing acts as production tubing for the duration of the test.

After drilling, logging and testing of a successful well, equipment may be installed for permanent production of fluids, which process is referred to as completion of the well. In a simple completion, casing is cemented into a well down to and usually through the producing zone. In open hole completions, casing may be installed only in an upper portion of the borehole. If casing extends through the producing zone, it is normally perforated in the producing zone to allow fluids to flow into the well. Production tubing is placed inside the well down to the producing zone. The tubing normally has a packer at or near its lower end. After being properly positioned, the packer is actuated to form a fluid tight seal between the production tubing and the borehole which forces produced fluids to flow through the tubing. If casing extends to the producing zone, the packer will seal to the casing. For open hole completions the packer will seal to the inner wall of the borehole. The space or annulus between the production tubing and the borehole or casing is usually filled with a completion fluid usually comprising salt water.

It is often desirable to install instrumentation packages as part of a well test or a well completion. For example, pressure and temperature measurement devices may be installed in the well at the producing zone. These devices need electrical power to operate and to transmit signals up to the surface location of the well. While it is possible to install electrical conductors down the well to provide power and signal paths, it has proven to be difficult and expensive, especially in deep wells. Typically, batteries do not survive long in the high temperature conditions usually found in deep wells and it could be very expensive to replace depleted batteries.

In wells with multiple producing zones, a completion often includes multiple production tubing strings. It also may include control valves for each string so that flow from each zone may be controlled for various reasons. These control valves generally need a power source to operate. If control valves are controlled by acoustic or electromagnetic signals sent from the surface location to a receiver near the control valves, the receiver needs electrical power to operate. As with downhole instruments, it is often difficult or impractical to provide the power and signals to such valves over electrical conductors, especially in deep wells.

It would be desirable to provide a source of power to downhole instruments, signaling systems, actuators and other devices in producing wells without installing electrical cables in the well.

SUMMARY OF THE INVENTION

In accordance with the present invention, a downhole power system includes a conduit bypassing a packer sealing element and means for using pressure differential in the fluids above and below the packer to provide power to instruments and actuators installed in the well.

In one embodiment, the system includes a fluid driven motor driving an electrical generator and an electrical storage device. A controller monitors the status of the storage device and allows fluid from the conduit to flow to the motor when the storage device needs to be recharged.

In another embodiment, a controller switches fluid flow from the conduit to hydraulically driven actuators which mechanically drive mechanical devices such as flow control valves.

DETAILED DESCRIPTION OF THE INVENTION

Figure 1:
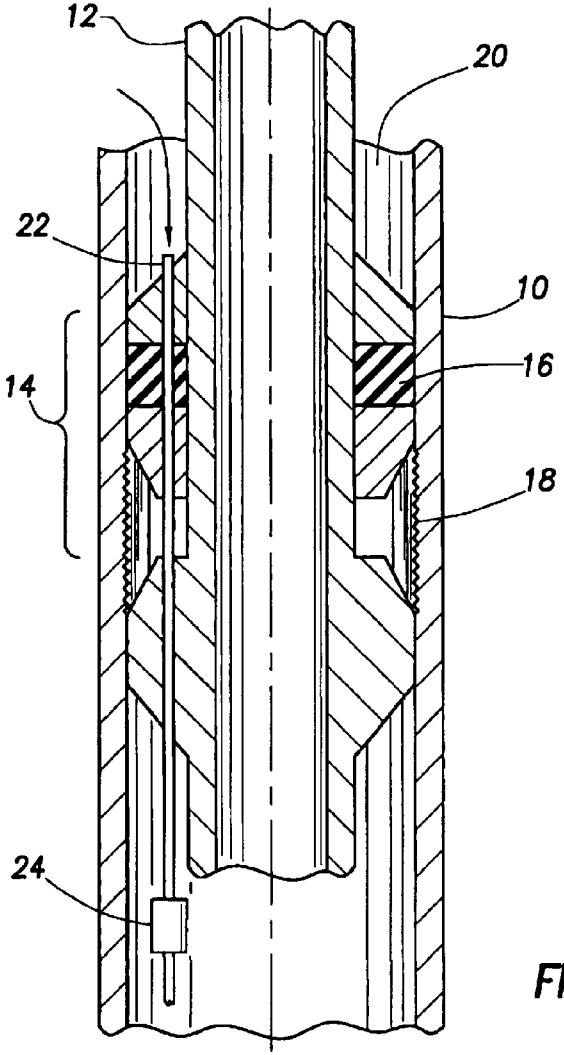
FIG. 1 is a cross sectional illustration of a production tubing string sealed to a well casing by a packer and a fluid conduit passing through the packer sealing element.

With reference to FIG. 1, a portion of a typical production well is illustrated. A well casing 10 is cemented into a borehole. A production tubing string 12 is positioned within casing 10. A packer 14 is positioned between tubing 12 and casing 10. Packer 14 includes a seal element 16 which provides a fluid tight seal between tubing 12 and casing 10. The packer 14 may also include slips 18 which grip the casing 10 and provide mechanical support for tubing 12 to hold it in the desired depth location. Fluids, e.g. oil, gas, brine, etc., produced from a zone below the packer 14 flow up through the tubing 12 to the surface location of the well.

Figure 5:
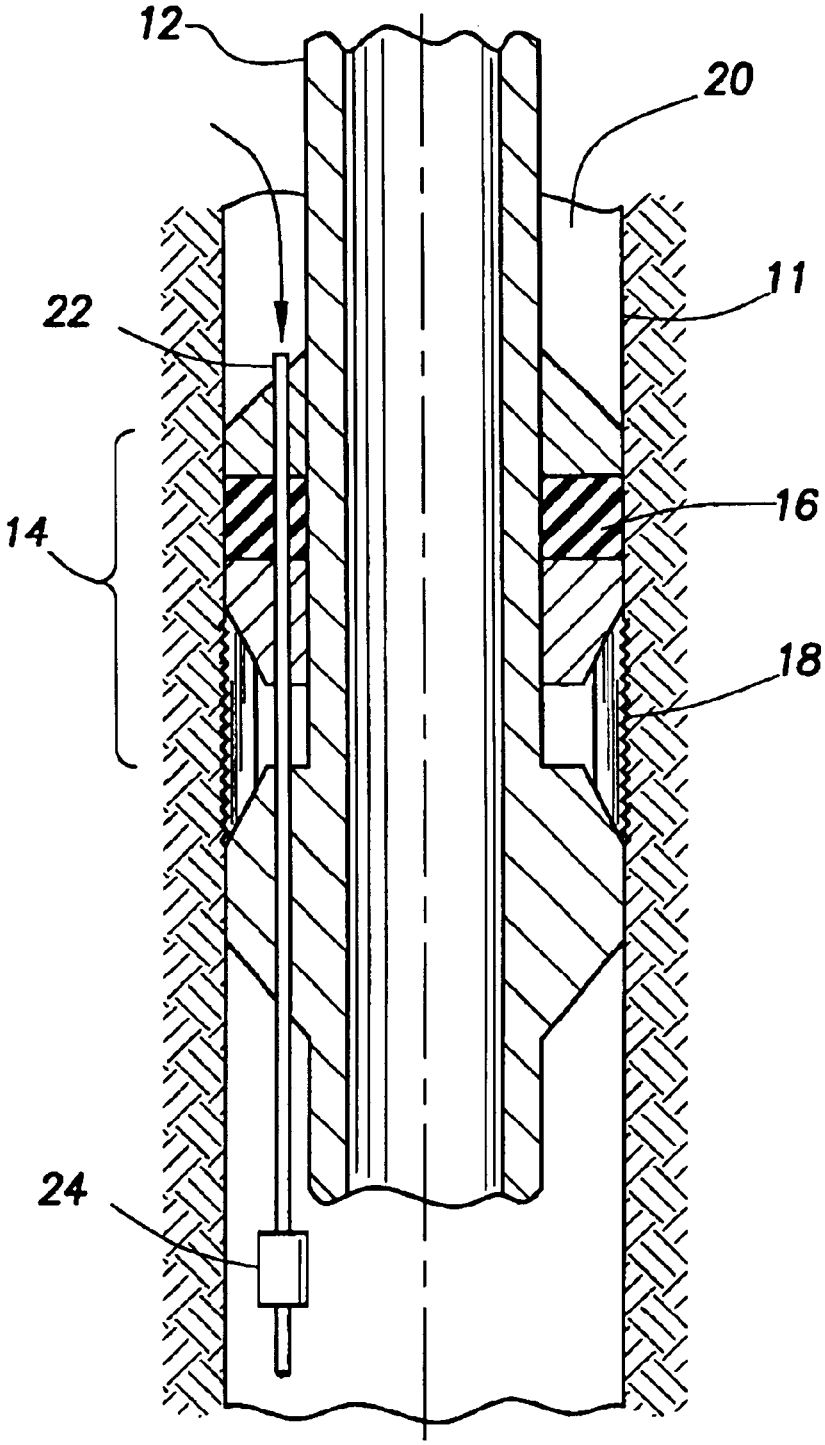
FIG. 5 is a cross sectional illustration of a production tubing string sealed to an uncased borehole by a packer and a fluid conduit passing through the packer sealing element.

For testing operations or for open hole completions, the packer 14 may seal against the inner wall 11 of an uncased well as shown in FIG. 5. Normally, inflatable packers are preferred for such applications. For purposes of the present invention, a packer is any device which provides a fluid seal between one or more production tubing strings and a well or, if the well is cased in the location of the packer, a well casing.

Between tubing 12 and casing 10 is an annular space or annulus 20. Above packer 14, the annulus is filled with a completion fluid which may comprise primarily salt water. During precompletion testing, the annulus may contain some drilling fluid, usually referred to as drilling mud. The annulus below packer 14 is filled with the produced fluids. In a typical well, the hydrostatic pressure of completion fluid above packer 14 may be 500 to 1500 psi, pounds per square inch, greater than the pressure of the produced fluids below packer 14.

In the present invention, a conduit 22 bypasses the seal element 16 to provide a flow path from the annulus 20 above packer 14 to the annulus below the packer. In the FIG. 1 embodiment, the conduit 22 passes through the seal element 16. In this embodiment, a check valve 24 is provided in conduit 22 to prevent flow of produced fluids from below packer 14 up into the annulus 20 above packer 14. Such upward flow through the annulus would not occur under normal production conditions where the pressure above packer 14 is greater than the pressure below packer 14. The check valve 24 is typically only helpful to protect against an unusual condition such as loss of the completion fluid above packer 14 or pressure increases below packer 14 which may occur during well treatments in which fluids are pumped down the production tubing 12.

Figure 2:
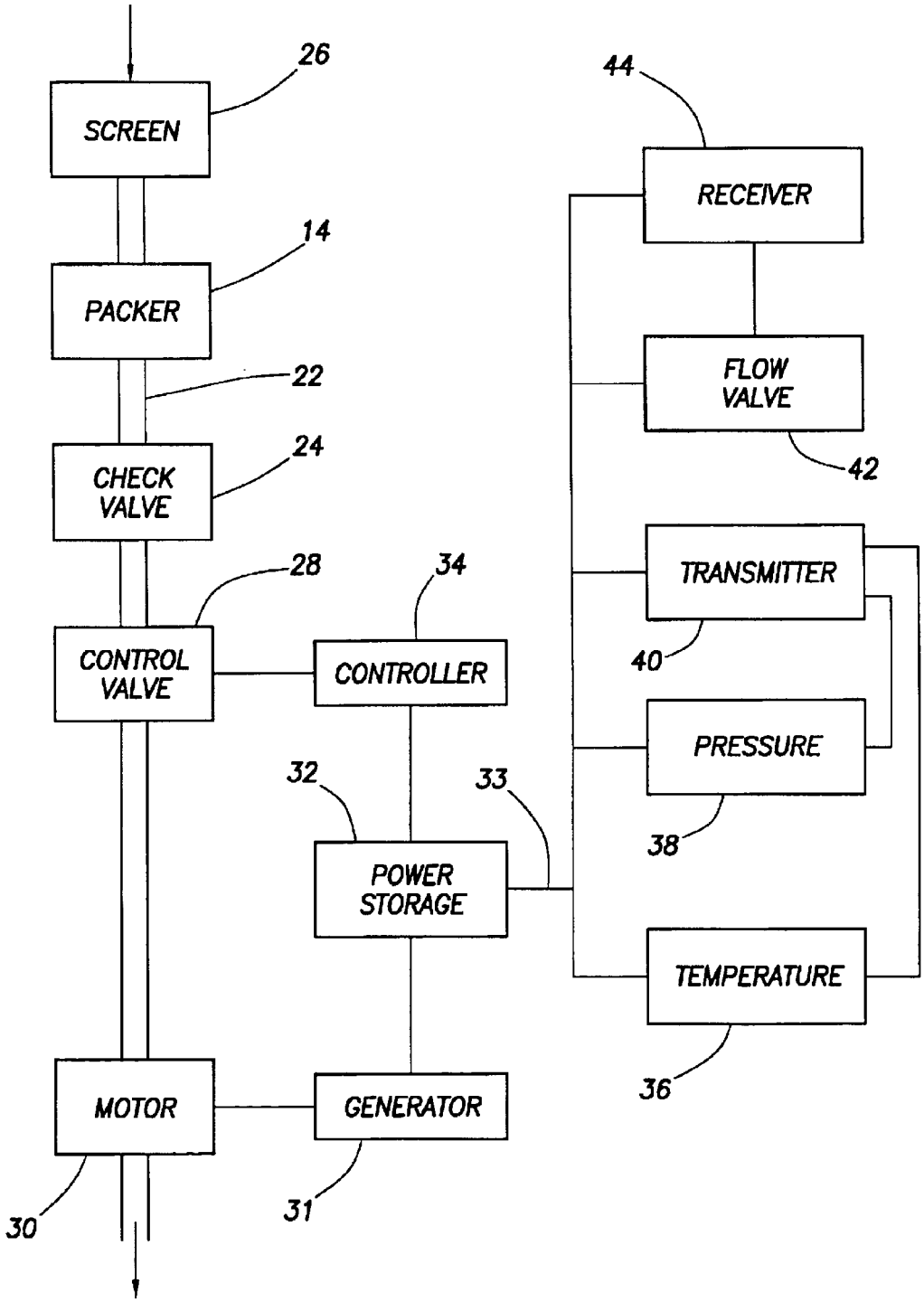
FIG. 2 is a block diagram of an embodiment of the present invention including an electrical power system driven by pressure differential between fluid above and below a packer in a producing well.

FIG. 2 is a block diagram illustrating an embodiment of a complete downhole power system according to the present invention. The packer 14 and check valve 24 of FIG. 1 are represented by blocks having the same reference numbers. The conduit 22 is also shown passing through the packer 14 to the check valve 24. In this embodiment, a screen 26 is connected to the top or inlet of tubing 22. The screen 26 filters out solids which may be present in the fluid above packer 14.

A fluid control valve 28 is coupled to the fluid conduit 22 at the lower end of check valve 24. The control valve 28 may also function as a check valve, in which case the separate check valve 24 would not be used.

A hydraulically driven motor 30 is coupled to the fluid conduit 22 through control valve 28. In this embodiment, the motor 30 is a fluid driven turbine. Other devices which produce mechanical rotation or other motion when driven by fluid flow may also be used. For example reciprocating pistons or hydraulic cylinders may be used. It is also known to use vibrators or flappers which move in response to fluid flow. The fluid outlet of motor 30 is open to the annulus below packer 14. Fluid passing through the motor 30 flows into the produced fluids and back up the production tubing 12 of FIG. 1.

An electrical generator 31 is coupled to and driven by the motor 30. The generator 30 may be a rotating electrical generator. Any other type of electrical generator capable of converting the mechanical motion produced by motor 30 into electrical power could be substituted if desired.

The motor 30 and generator 31 are typically assembled in a single motor/generator housing. A solid mechanical connection is needed because the power output of the motor 30 is in the form of mechanical motion, usually rotation of a shaft. The power input to the electrical generator 31 is the same mechanical motion. The combined motor 30 and generator 31 unit may appear to be a single device, and may be referred to as a hydraulically driven generator.

An electric power storage unit 32 is coupled to generator 31 to receive and store electrical power. The storage unit 32 may comprise rechargeable batteries suitable for the typical high temperature conditions found in producing wells. In a preferred embodiment, the storage unit 32 comprises a capacitor, because it is more practical to find capacitors which withstand more extreme downhole conditions.

A controller 34 is electrically coupled to both control valve 28 and to power storage unit 32. The controller 34 monitors the condition of storage unit 32 and opens control valve 28 when storage unit 32 needs to be recharged. The controller 34 has two voltage set points. When the voltage of the storage device drops to a lower set point, the controller 34 opens control valve 28 which allows fluid to flow through motor 30 which then drives generator 31 which supplies charging current to storage device 32. As the storage device 32 charges up, the voltage increases until it reaches an upper set point at which time the controller 34 closes the valve 28 and the motor 30 and generator 31 stop producing charging current. If the power storage unit 32 comprises a capacitor, the voltage on the device will have somewhat of a sawtooth waveform.

In a preferred embodiment, the storage unit 32 includes a power conditioner or voltage regulator on its output 33. The voltage regulator provides a regulated voltage for the electronic devices which use the stored power. Voltage spikes, sawtooth waveforms, etc. which could interfere with operations of other devices are removed.

A temperature sensing or measuring device 36 and a pressure sensing or measuring device 38 are electrically coupled to power storage unit 32. The devices 36 and 38 use electrical power from storage unit 32 to measure temperature and pressure and convert the measurements into signals which may be transmitted to a receiver at the surface location of the well. Each measuring device 38, 36 may be coupled to a transmitter 40 which may convert the signals from devices 38, 36 into acoustic or electromagnetic telemetry signals for transmission to the surface location of the well. The transmitter 40 is also coupled to the power storage unit 32, from which it obtains the electrical power it needs to operate.

While acoustic or EM telemetry are preferred, any other form of telemetry as understood by those skilled in the art could also be employed. For example, copper wires or optical fibers may be installed in a borehole to provide one or more telemetry channels. For the purposes of this disclosure, a transmitter may be a transmitter for any type of telemetry system and a receiver may be a receiver for any type of telemetry system.

As noted above, well completions, especially those having multiple production tubing strings, often include at least one production flow control valve. In FIG. 2, a flow valve 42 is shown coupled to power storage unit 32, from which it obtains electrical power needed to open or close. A signal receiver 44 is coupled to power storage unit 32 and to the flow valve 42. The receiver 44 uses electrical power from storage unit 32 to receive signals transmitted from up hole and to send control signals to valve 42 causing it to open or close, or partly open or close, as instructed. Signals from up hole may be transmitted by any telemetry system to the receiver 44.

In operation of the FIG. 2 embodiment, each of the electrical power using devices 34, 36, 38, 40, 42 and 44 draws power from storage unit 32 as needed to perform its intended functions. Controller 34 monitors the level of power stored in storage unit 32. When the level of power stored in storage unit 32 is depleted below a minimum set point, the controller 34 opens control valve 28. This allows fluid to flow through conduit 22 to motor 30 which drives generator 31 which drives a charging current to power storage unit 32. The charging current recharges the storage battery or capacitor. The driving fluids which pass through motor 30 are vented into the production stream and return to the surface though production tubing 12, FIG. 1.

The charging current from generator 31 may effectively flow through storage unit 32 to any of the devices 34, 36, 38, 40, 42 and 44 which are drawing power at the time. For example, flow valve 42 may require relatively high currents when opening or closing and could quickly deplete storage unit 32. The motor 30 and generator 31 may automatically continue to run during such operations of flow valve 42 to provide the necessary power. Likewise transmissions of signals by transmitter 40 may require relatively large currents which would cause controller 34 to open control valve 28 during such transmissions. However, the operation of flow valve 42 and the transmissions from transmitter 40 occur only for short periods of time. Between such large power usage times, only small amounts of electrical power are needed and the controller 34 will need to open control valve 34 and operate the motor 30 for short periods of time to recharge the storage device 32.

If desired, some downhole devices may be directly driven by the output of generator 31 without power conditioning in storage unit 32. For example, the production flow valve 42 may need relatively high power to operate, but would not necessarily need a closely controlled voltage to operate. By connecting it directly to the output of generator 31, the power storage unit 32 and its power conditioning circuitry can be of smaller size. In a simple embodiment of the present invention, the power storage unit 32 and its power conditioning circuitry can be eliminated completely. For example, receiver 44 may be battery powered and may be coupled to control valve 28 as well as flow valve 42. In response to received telemetry signals, receiver 44 could turn on control valve 28 and command flow valve to open or close using unregulated power directly from generator 31.

Figure 3:
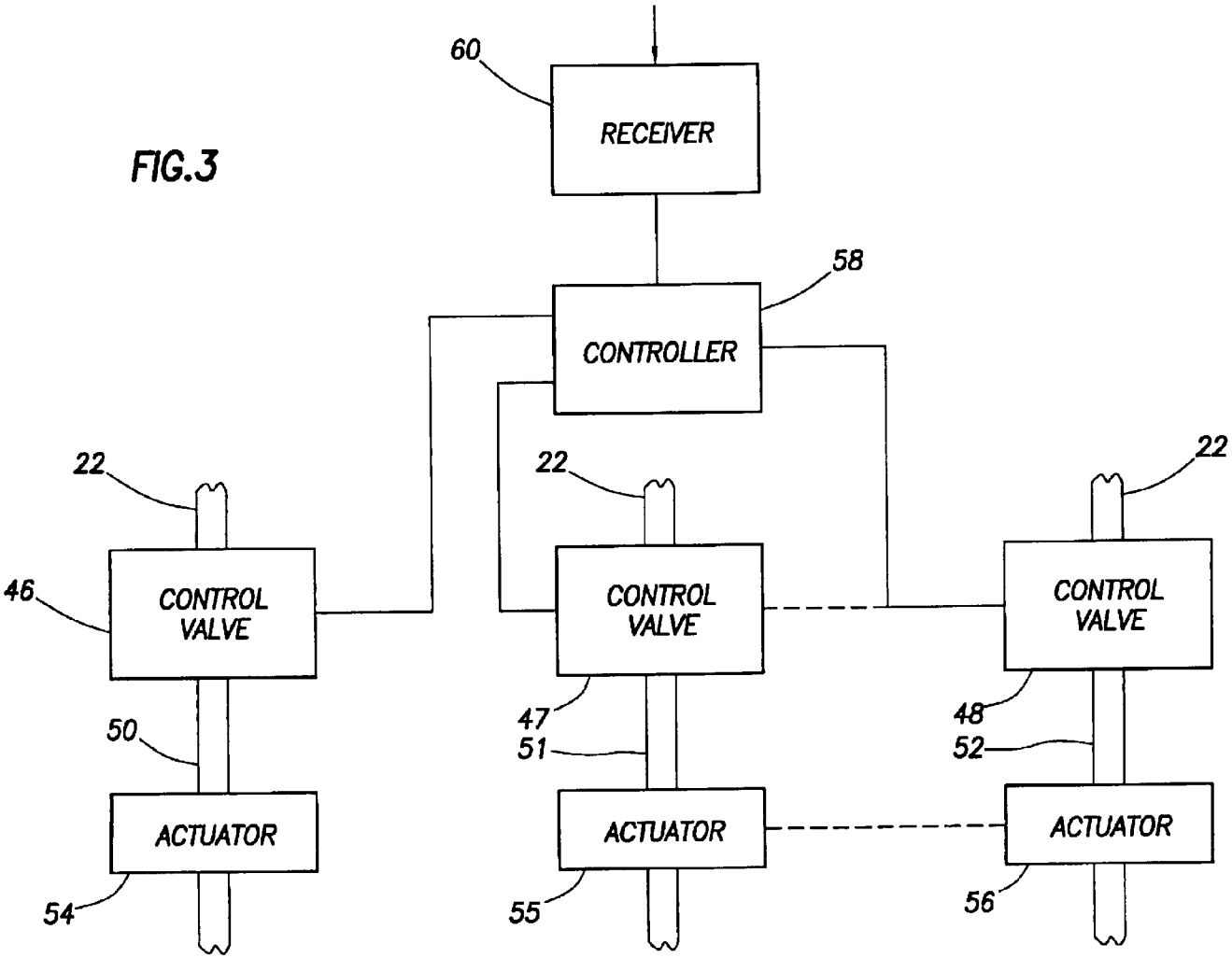
FIG. 3 is a block diagram of an embodiment in which pressure differential across a packer in a producing well is used to drive hydraulically driven actuators.

FIG. 3 is an alternate embodiment of the present invention which may be combined with the FIG. 2 embodiment if desired. In this embodiment, conduit 22 is coupled to one or more control valves 46, 47, 48. Each valve 46–48 has a fluid outlet 50, 51, 52 coupled to a set of fluid driven actuators 54, 55, 56. Actuators 54–56 may be for example hydraulic cylinders or motors. A controller 58 is coupled to each control valve 46–48 to open or close the valves 46–48 and thereby control actuators 54–56. A receiver 60 receives signals from up hole containing instructions as to which actuator 54–56 should be activated. Controller 58 and receiver 60 may obtain electrical power from batteries or may be connected to the power storage unit 32 of FIG. 2.

In operation of the FIG. 3 embodiment, an operator at the surface location of a well may transmit telemetry signals directing the operation of one or more of the actuators 54–56. For example, actuator 54 may be connected to a production control valve like valve 42 of FIG. 2. Actuators 54 and 55 may represent two inlets to a double acting piston, one for opening a valve and one for closing the valve. In this case the control valve would be opened or closed by hydraulic means instead of electrical means. In this embodiment, the power available from the fluid flowing through conduit 22 may be used directly to actuate a mechanical device. That is, the hydraulic power does not need to be converted to mechanical power in motor 30, then to electrical power in generator 31 and then to mechanical power to drive the actuator. This arrangement may remove some of the larger electrical requirements from motor 30, generator 31 and power storage unit 32 of FIG. 2. Motor 30, generator 31 and storage unit 32 may therefore be of smaller size and or may have a longer operating lifetime.

As noted above, commands may be sent from a surface location to a downhole location by various telemetry methods, e.g. acoustic or electromagnetic. It is also known in producing wells to control downhole equipment by tripping or triggering it mechanically by using tools run on slick line or coiled tubing or pumped down production tubing hydraulically. Any of such mechanical control arrangements may be used in the present invention to activate the control valve 28 or the flow valve 42 of FIG. 2 or any of the control valves 46–48 of FIG. 3.

It is apparent that in operation of the present invention, completion fluid is allowed to flow into the production stream below packer 14, FIG. 1. While this would appear to be undesirable, the advantages of the present invention outweigh the disadvantages. For example, it is desirable that the annulus above packer 14 remains filled with completion fluid. In a typical well having a depth of 15,000 feet, casing inner diameter of 9.625 inches and tubing outer diameter of 3.5 inches, the annulus above packer 14 would contain about 37,500 gallons of completion fluid. Due to the high pressure differential available, only small amounts of fluid are required to drive the motor 30 of FIG. 2 and or the actuators 54–56 of FIG. 3. These small amounts are easily made up for by existing automatic systems which regulate the level of completion fluid at the surface location of the well.

In similar fashion, only small amounts of fluid are allowed to enter the production stream. Produced fluids normally contain natural brine which is separated by equipment at the surface location of the well. The completion fluid is primarily salt water and will be automatically removed by the separation equipment.

In exchange for these disadvantages, the present invention provides long term electrical power to downhole instruments and actuators without requiring the use of cables running the length of the well. Installation of such cables is difficult and expensive. They often are damaged during installation or during production. The alternative of using batteries which must be replaced from time to time is also expensive.

Figure 4:
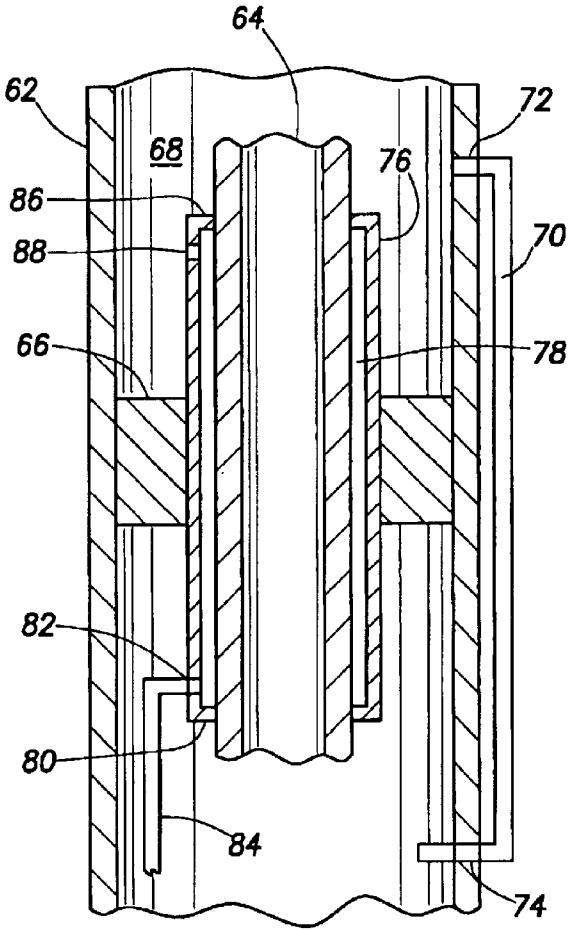
FIG. 4 is a cross sectional illustration of two alternative arrangements for a conduit bypassing a packer in a producing well.

The conduit 22 shown in FIG. 1 provides a path for fluid to bypass the packer 14, that is a path for the fluid in the annulus above packer 14 to flow into the annulus below packer 14. Two alternative bypass arrangements or flow paths are illustrated in FIG. 4. In FIG. 4 is illustrated a well casing 62 and a production tubing string 64. A packer is represented by a seal element 66 positioned in the annulus 68 between the casing 62 and production tubing 64.

A first alternative bypass arrangement comprises a modified section of the well casing 62. A section of conduit 70 is positioned outside casing 62 and connected between an upper opening or port 72 and a lower opening or port 74 in casing 62. The upper opening 72 passes through casing 62 above packer seal element 66 to provide a flow path for completion fluid in the annulus 68 above the seal element 66. A filter device, e.g. screen 26 of FIG. 2, may be coupled to opening 72 to prevent solids from flowing into conduit 70. The lower opening 74 passes through the casing 62 below packer seal element 66 to provide a flow path for completion fluid to flow to the devices shown in FIGS. 2 and 3. The conduit 70 is desirably welded to the outer surface of casing 62, or shielded, to protect it from damage during the processes of running the casing 62 into the well and cementing the casing.

A second alternative bypass arrangement may comprise a modified section of the production tubing 64. A concentric sleeve 76 is attached to the outer surface of tubing 64 in the area of the packer 66. A small annulus 78 between sleeve 76 and tubing 64 provides a flow path bypassing the packer 66. The sleeve is sealed to the tubing 64 at least around its lower end at 80. An outlet or port 82 is connected to a conduit 84, which may be connected to the devices which use hydraulic fluid in FIGS. 2 and 3. The upper end of sleeve 76 may also be sealed to the tubing 64 at 86 so that completion fluid must enter the annulus 78 though a port 88. Port 88 may be connected to a filter device such as screen 26 of FIG. 2. Alternatively, the upper end of sleeve 78 may be attached to or may comprise a section of screen surrounding tubing 64.

While two alternative bypass arrangements are illustrated in FIG. 4, it is understood that only one of these arrangements, or the arrangement of FIG. 1, would be used in any given well. Other bypass arrangements will be apparent to those skilled in the art and may be substituted for those illustrated and described herein.

It is apparent that various changes can be made in the apparatus and methods disclosed herein, without departing from the scope of the invention as defined by the appended claims.

What I claim as my invention is:

1. A system for providing power to devices in a producing well having a production tubing, a packer sealing an annulus between the well and tubing, completion fluid in the annulus above the packer and produced fluids below the packer, comprising:

a conduit connecting the annulus above said packer to the annulus below said packer, and an electrical generator located in said well below said packer coupled to said conduit using energy from completion fluid flowing through said conduit to generate electrical power.

2. A system according to claim 1 further comprising a motor located in said well below said packer, driven by said completion fluid flowing through said conduit and providing a mechanical motion output.

3. A system according to claim 2 wherein said motor is a hydraulically driven turbine.

4. A system according to claim 2 wherein said electrical generator is mechanically coupled to and driven by said motor.

5. A system according to claim 1, wherein said packer comprises a seal element and said conduit passes through said seal element.

6. A system according to claim 1, wherein said conduit comprises a sleeve positioned around said production tubing and between said packer and said production tubing.

7. A system according to claim 1, further comprising an electrical power storage device coupled to said generator for storing electricity produced by said generator.

8. A system according to claim 7, further comprising a controller coupled to said power storage device and to said electrical generator controlling the flow of completion fluid through said conduit to maintain a preselected minimum level of power in said power storage device.

9. A system according to claim 8, further comprising one or more electrically operated devices coupled to and powered by electricity stored in said power storage device.

10. A system according to claim 1, further comprising a casing lining the well, wherein said packer seals between said production tubing and said casing.

11. A system according to claim 1, wherein said well is uncased and said packer seals between said production tubing and the inner wall of said well.

12. A system for providing power to devices in a producing well having a production tubing, a casing lining the well, a packer sealing an annulus between the well casing and tubing, completion fluid in the annulus above the packer and produced fluids below the packer, comprising:

a conduit connecting the annulus above said packer to the annulus below said packer, and an electrical generator coupled to said conduit using energy from completion fluid flowing through said conduit to generate electrical power, wherein said casing has a first port above said packer and a second port below said packer and said conduit is positioned outside said casing and connected between said first port and said second port.

13. A system for providing power to devices in a producing well having a production tubing, a packer sealing an annulus between the well and tubing, completion fluid in the annulus above the packer and produced fluids below the packer, comprising:

a conduit connecting the annulus above said packer to the annulus below said packer, and a hydraulically driven actuator located in said well below said packer coupled to said conduit using completion fluid flowing through said conduit to provide power to devices located in said well.

14. A system according to claim 13, wherein said packer comprises a seal element and said conduit passes through said seal element.

15. A system according to claim 13, wherein said conduit comprises a sleeve positioned around said production tubing and between said packer and said production tubing.

16. A system according to claim 13, further comprising a controller coupled to said conduit for controlling the flow of completion fluid to said actuator.

17. A system according to claim 16, further comprising a flow control valve coupled to said conduit and to said controller and permitting or stopping fluid flow through said conduit in response to signals from said controller.

18. A system according to claim 17, further comprising a receiver coupled to said controller receiving control signals transmitted from the surface location of the well and providing signals to said controller causing it to permit or stop fluid flow through said conduit.

19. A system according to claim 13, further comprising a casing lining the well, wherein said packer seals between said production tubing and said casing.

20. A system according to claim 13, wherein said well is uncased and said packer seals between said production tubing and the inner wall of said well.

21. A system for providing power to devices in a producing well having a production tubing, a casing lining the well, a packer sealing an annulus between the casino and tubing, completion fluid in the annulus above the packer and produced fluids below the packer, comprising:

a conduit connecting the annulus above said packer to the annulus below said packer, and a hydraulically driven actuator coupled to said conduit using completion fluid flowing through said conduit to provide power to devices located in said well, wherein said casing has a first port above said packer and a second port below said packer and said conduit is positioned outside said casing and connected between said first port and said second port.

22. A system for providing power to devices in a producing well having a production tubing, a packer sealing an annulus between the well and tubing, completion fluid in the annulus above the packer and produced fluids below the packer, comprising:

a conduit connecting the annulus above said packer to the annulus below said packer, and power means located in said well below said packer coupled to said conduit for using completion fluid flowing through said conduit to provide power to devices located in said well.

23. A system according to claim 22, wherein said packer comprises a seal element and said conduit passes through said seal element.

24. A system according to claim 22, wherein said conduit comprises a sleeve positioned around said production tubing and between said packer and said production tubing.

25. A system according to claim 22, wherein said power means comprises a hydraulic turbine and an electrical generator, said turbine coupled to said conduit and driven by completion fluid flowing through said conduit and coupled to said generator to drive said electrical generator.

26. A system according to claim 25, further comprising electrical power storage means coupled to said generator for storing electricity produced by said generator.

27. A system according to claim 26, further comprising a controller coupled to said storage means and to said power means controlling the flow of completion fluid through said conduit to maintain a preselected minimum level of power in said storage means.

28. A system according to claim 27, further comprising one or more electrically operated devices coupled to and powered by electricity stored in said storage means.

29. A system according to claim 22, wherein said power means comprises an actuator providing mechanical motion when driven by fluid flowing through said conduit.

30. A system according to claim 29, further comprising a controller coupled to said conduit for controlling the flow of fluid to said actuator.

31. A system according to claim 30, further comprising a flow control valve coupled to said conduit and to said controller and permitting or stopping fluid flow through said conduit in response to signals from said controller.

32. A system according to claim 31, further comprising a receiver coupled to said controller receiving control signals transmitted from the surface location of the well and providing signals to said controller causing it to permit or stop fluid flow through said conduit.

33. A system for providing power to devices in a producing well having a production tubing, a packer sealing an annulus between the well and tubing, completion fluid in the annulus above the packer and produced fluids below the packer, comprising:

a conduit connecting the annulus above said packer to the annulus below said packer, and power means coupled to said conduit for using completion fluid flowing through said conduit to provide power to devices located in said well, further comprising casing lining said well, wherein said casing has a first port above said packer and a second port below said packer and said conduit is positioned outside said casing and connected between said first port and said second port.

34. A method for providing power to devices in a producing well having a production tubing, a packer sealing an annulus between the well and tubing, completion fluid in the annulus above the packer and produced fluids below the packer, comprising using pressure differential between completion fluid above said packer and produced fluid below said packer and flowing completion fluid from above said packer to a hydraulically driven device located in said well below said packer to provide power to said devices.

35. A method according to claim 34 wherein said hydraulically driven device is a motor.

36. A method according to claim 35 further comprising driving an electrical generator with said motor.

37. A method according to claim 36 further comprising coupling electrical power from said electrical generator to electrically operated devices in said well.

38. A method according to claim 34 wherein said hydraulically driven device is an actuator providing a mechanical motion in response to a hydraulic input.

39. A method according to claim 38, further comprising coupling mechanical motion from said actuator to a mechanically operated device in said well.

* * * * *